US008453919B2

(12) United States Patent
Eckermann et al.

(10) Patent No.: US 8,453,919 B2
(45) Date of Patent: Jun. 4, 2013

(54) CONTAINER CARRIER FROM FOLDABLE FLAT MATERIAL

(75) Inventors: Jens Eckermann, Bremen (DE); Bernard Skolik, Bassum (DE); Harmen Boersma, Heerenveen (NL)

(73) Assignee: A & R Carton BV, Sneek (NL)

( * ) Notice: Subject to any disclaimer, the term of this patent is extended or adjusted under 35 U.S.C. 154(b) by 111 days.

(21) Appl. No.: 13/091,407

(22) Filed: Apr. 21, 2011

(65) Prior Publication Data

US 2012/0193404 A1 Aug. 2, 2012

(30) Foreign Application Priority Data

Jan. 31, 2011 (DE) ..... 20 2011 002 141 U

(51) Int. Cl.
*B65D 5/468* (2006.01)

(52) U.S. Cl.
USPC ..... 229/117.13; 229/199

(58) Field of Classification Search
USPC ..... 229/117.13, 117.14, 199; 206/141, 206/427
See application file for complete search history.

(56) References Cited

U.S. PATENT DOCUMENTS

| | | | | |
|---|---|---|---|---|
| 4,331,289 | A * | 5/1982 | Killy | 229/117.13 |
| 5,772,030 | A * | 6/1998 | Baxter | 206/427 |
| 5,996,883 | A * | 12/1999 | Bates | 229/117.13 |
| 6,170,741 | B1 * | 1/2001 | Skolik et al. | 229/117.13 |
| 2003/0136820 | A1 * | 7/2003 | Negelen | 229/117.13 |
| 2005/0167478 | A1 * | 8/2005 | Holley | 229/117.13 |
| 2007/0199979 | A1 * | 8/2007 | Holley | 229/117.13 |
| 2010/0237138 | A1 * | 9/2010 | Bradford | 229/117.13 |
| 2010/0243721 | A1 * | 9/2010 | Dunn | 229/117.13 |
| 2011/0068160 | A1 * | 3/2011 | Brand et al. | 229/199 |
| 2012/0091021 | A1 * | 4/2012 | Smalley | 206/427 |

FOREIGN PATENT DOCUMENTS

| | | |
|---|---|---|
| EP | 0 630 826 A1 | 12/1994 |
| EP | 0 983 946 B1 | 3/2000 |
| EP | 0 983 946 B1 | 1/2003 |

* cited by examiner

*Primary Examiner* — Gary Elkins
(74) *Attorney, Agent, or Firm* — Vidas, Arrett & Steinkraus P.A.

(57) ABSTRACT

A container carrier for bottles having a blank made of cardboard for wrapping around a group of bottles, a grip portion is stabilized between the two handle openings and the further handle opening by at least three layers of cardboard, a first layer is formed by the web defined by the handle openings in the top wall.

20 Claims, 7 Drawing Sheets

CONTAINER CARRIER FROM FOLDABLE FLAT MATERIAL

CROSS-REFERENCE TO RELATED APPLICATIONS

Not applicable

STATEMENT REGARDING FEDERALLY SPONSORED RESEARCH

Not applicable

BACKGROUND OF THE INVENTION

The invention relates to a container carrier made of cardboard or a different foldable flat material for wrapping around a group of bottles or other containers. A bottle carrier of the type mentioned in the introduction is disclosed in EP 0 630 826 A1, the entire contents of which is incorporated herein by reference. Said bottle carrier comprises a one-piece blank of foldable flat material such as cardboard placed around a group of bottles in the manner of a sleeve. The blank has a bottom wall, side walls articulated to the longitudinal sides of the bottom wall and a fitted-together top wall made up of internal and external top wall portions articulated to the upper longitudinal sides of the side walls and glued together in an overlapping region. The front walls are formed from front wall tabs articulated to the transverse sides of the bottom wall, side walls and top wall, pivoted therebetween into the openings and glued together in overlapping regions. The top wall has two handle openings spaced apart from one another in the transverse direction. The overlapping region of the outer and inner top wall portion forms between the handle openings a grip portion for gripping through the handle openings. The grip portion is configured to be triple-ply by a grip reinforcement tab, which is folded against the inner face of the inner top wall portion. The bottom wall front tabs are connected via corner connecting tabs to side wall front tabs, which are folded against the inner faces of the side walls. The top wall front tabs are extended over the entire transverse sides of the outer top wall portion which is congruent with the top wall and by means of connecting portions are connected to the outer faces of the bottom wall front tabs level with the body of the bottles.

When carrying this container carrier, large forces act on the grip portion, so that the top wall may be considerably deformed. Moreover, the connecting regions between the top wall, the side walls and the front walls may be deformed as a result of the high loads. In particular, unpleasant deformations may be present at the corners of the top wall. The highly asymmetrical weakness of the top wall contributes to this through the grip reinforcement tab.

EP 0 983 946 B1, the entire contents of which is incorporated herein by reference, discloses a container carrier with a blank made of cardboard or a different foldable flat material, which has a bottom wall, side walls and a top wall, which are articulated to one another on the longitudinal sides. A connection is present between one of these walls and an adjacent wall via an adhesive tab. Alternatively, portions which overlap one another of one of these walls are glued together. The front openings are entirely or partially closed by front walls, which are connected to the blank. Moreover, the container carrier has a further blank made of cardboard or a different foldable flat material, which may be arranged above the group of containers. This blank has a reinforcement wall arranged below the top wall and two further handle openings in the reinforcement wall spaced apart from one another and arranged below the handle openings of the top wall. The reinforcement wall is configured to be substantially congruent with the top wall. It has longitudinal tabs articulated to the longitudinal sides and is connected to the blank wrapped around the containers.

Said container carrier has the required strength in the grip region and has a reduced tendency to deformation in the region of the side walls, front walls and corners.

Proceeding therefrom, the object of the invention is to provide a container carrier of the aforementioned type, which further improves the strength in the grip region and the stability.

SUMMARY OF THE INVENTION

The container carrier according to the invention for bottles or other containers comprises

- a blank made of cardboard or a different foldable flat material for wrapping around a group of bottles or other containers, comprising:
- a bottom wall, a side wall, a top wall and a further side wall as sleeve walls, adjacent sleeve walls being articulated to one another on the longitudinal sides,
- two handle openings in the top wall spaced apart from one another and laterally defining a web,
- an adhesive tab on one longitudinal side of a sleeve wall for connecting to a further sleeve wall or two wall portions of a sleeve wall separated from one another with an overlapping region for forming the sleeve wall by joining the wall portions together in a congruent relationship, and
- front walls articulated to the front faces of at least one sleeve wall for closing front openings between the sleeve walls, and
- a further blank made of cardboard or a different foldable flat material to be arranged above the group of containers comprising:
- a reinforcement wall arranged below the top wall,
- two further handle openings in the reinforcement wall arranged spaced apart from one another and arranged below the handle openings of the top wall and
- longitudinal tabs and/or transverse tabs articulated to the longitudinal sides and/or to the transverse sides of the reinforcement wall, characterised in that
- adjacent to the two further handle openings in the reinforcement wall one respective reinforcement tab is die cut, which partially encloses the handle openings and is articulated to the reinforcement wall via two articulation lines, which protrude from different sides of the further handle openings, and
- the reinforcement tabs for forming a reinforced grip portion may be folded towards the further web of the reinforcement wall defined by the two further handle openings.

In the container carrier according to the invention, the grip portion is stabilised between the two handle openings and the further handle opening by at least three layers of cardboard. A first layer is formed by the web defined by the handle openings in the top wall. The further web of the reinforcement wall defined by the further handle openings forms a second layer. A third layer is formed by the two reinforcement tabs, when said reinforcement tabs are folded towards the reinforcement wall, so that they are located adjacent to one another between the further handle openings. If the reinforcement tabs are folded on top of one another, they form a third and a fourth layer of the grip portion. The arrangement of the reinforcement tabs adjacent to one another in order to form together a third layer of the web is preferred, in order to avoid an excessive weakening of the reinforcement wall by die cut portions which are too large. The reinforcement wall at the same time stabilises the side walls and front walls and the corners of the top wall. The longitudinal tabs and/or the transverse tabs contribute to avoiding deformations of the side edges and the corners. For stability it is advantageous if each reinforcement tab only covers part of the web, and the reinforcement tabs together form a third layer, as then the stability of the top wall is only slightly reduced by die cut portions.

According to a further embodiment, the reinforcement tabs are folded towards the reinforcement wall and glued thereto or fixed in this position by a further connection. As a result, the reinforcement wall is further reinforced and secured, so that the reinforcement tabs are not damaged when inserting containers through the front openings.

According to one embodiment, the blank and the further blank are connected together. Further preferably, the top wall and the reinforcement wall are connected together. Preferably, the two blanks are connected together by gluing. As a result, the erection and filling of the container carrier with containers as well as the closing of the front openings is simplified.

According to one embodiment, the handle openings and/or the further handle openings are elongated and are aligned with their main directions of extension parallel to the longitudinal sides of the sleeve walls. This is particularly advantageous for the loading of the grip portion when carrying, when a larger number of bottles is arranged in the longitudinal direction of the bottle carrier than in the transverse direction.

According to a further embodiment, the handle openings and/or the further handle openings are substantially rectangular. Preferably the handle openings and/or the further handle openings have rounded corners. As a result, stress concentration points in the top wall and/or the reinforcement wall are avoided and a comfortable grip in the further handle openings is promoted.

According to a further embodiment, the handle openings and/or the further handle openings have grip relief tabs and/or further grip relief tabs articulated to their inner edges. The grip relief tabs reduce the pressure of the inner edges on the surfaces of the hand and at the same time effect a further reinforcement of the grip portion.

According to a further embodiment, the reinforcement tabs and the connecting portions connecting their articulated portions to the articulation lines are arranged on sides of the further handle openings remote from one another. Thus the reinforcement tabs with the connecting portions are able to be folded beyond the further handle openings towards the further web between the further handle openings.

According to a further embodiment, the reinforcement tabs are substantially rectangular as far as the regions incorporated by the further handle openings.

According to a further embodiment, the reinforcement tabs cover at least 80%, preferably at least 90% of the further web between the two further handle openings. As a result, the grip portion is particularly advantageously reinforced.

According to a further embodiment, the transverse tabs comprise recesses through which the bottle cap regions of bottles may be introduced when inserted into the front openings of the erected blank. By means of the recesses it is avoided that the transverse tabs hinder the insertion of the bottles.

In a further embodiment, the transverse tabs have a central recess and/or lateral recesses. Preferably, the central recess is V-shaped. Further preferably, the lateral recesses are chamfers on the edges of the transverse tabs, through which the width of the transverse tabs is reduced when the distance increases from their articulation to the reinforcement wall.

According to a further embodiment, the reinforcement wall is substantially congruent with the top wall. As a result, the corners and edges in the region of the top wall are particularly stabilised. Preferably, the reinforcement wall and top wall are congruent.

According to a further embodiment, proceeding from the handle openings and/or the die cut portions of the reinforcement tabs in the top wall and/or in the reinforcement wall, fold lines extend as far as the adjacent corners of the top wall and/or the reinforcement wall. Along the fold lines, the forces may be diverted into the corner regions. As a result, the container carrier is further stabilised.

According to a further embodiment, from the outer regions of the handle openings of the top wall and/or the die cut portions of the reinforcement tabs of the reinforcement wall in each case two weakening lines extend spaced apart from one another substantially in the transverse direction, as far as the longitudinal sides, and from there into the side walls and/or into the longitudinal tabs. The container carrier may be opened by tearing open along the weakening lines, in order to remove bottles.

Preferably, the weakening lines extending into the side walls are connected together at their lower ends by longitudinally oriented weakening lines, in order to form automatically tear tabs which may be torn off from the container.

According to a further embodiment, the blank and/or the further blank are produced from kraftboard. Further preferably, the blank has a grammage of less than 500 g/m$^2$, preferably less than 250 g/m$^2$, in particular approximately 295 g/m$^2$. The further blank may also be produced from kraftboard. In particular, the further blank may have the aforementioned weight.

According to a preferred embodiment, the further blank is produced from recycled cardboard and/or kraftboard. The recycled cardboard is particularly cost-effective and lends the desired stability to the container carrier.

According to a further embodiment, the blank is produced from coated cardboard material and/or the further blank is produced from uncoated cardboard material. As a result, printing of the outer faces of the blank is promoted.

The invention is described in more detail hereinafter with reference to the accompanying drawings of an exemplary embodiment, in which:

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
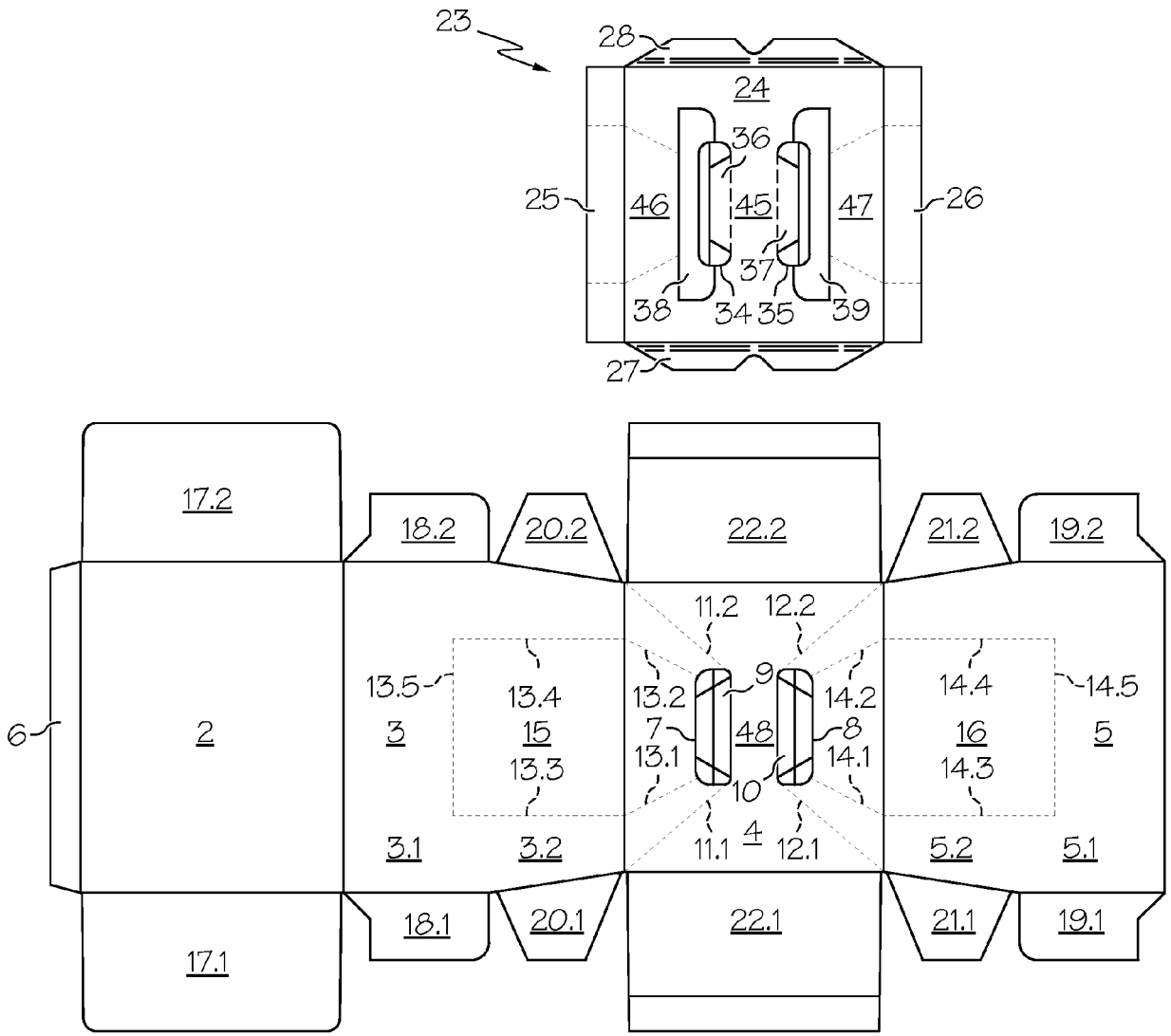
FIG. 1 shows a blank for wrapping around a group of bottles, in addition to a further blank for arranging above the group of bottles, in each case spread out flat in a view from below.

The blank 1 shown at the bottom in FIG. 1 has a bottom wall 2, a side wall 3 articulated to the longitudinal side of the bottom wall 2, a top wall 4 articulated to a further longitudinal side of the side wall 3, and a side wall 5 articulated to a further longitudinal side of the top wall 4. An adhesive tab 6 is articulated to a further longitudinal side of the bottom wall 2. The bottom wall 2, side walls 3, 5 and top wall 4 are also denoted in this application as "sleeve walls", as they are intended to be wrapped around a group consisting of a plurality of containers (for example bottles) in the manner of a sleeve.

The bottom wall 2 and the top wall 4 are in each case rectangular, the top wall 4 having a slightly smaller longitudinal extent than the bottom wall 2. The side walls 3, 5 have in each case a lower side wall portion 3.1, 5.1 in the form of a rectangle and an upper side wall portion 3.2, 5.2 in the form of a trapezium.

The top wall 4 has handle openings 7, 8 arranged symmetrically to its longitudinal centre axis and spaced apart from one another, grip relief tabs 9, 10 being pivotably articulated on the inner edges thereof facing one another. The handle openings 7, 8 are elongate, their main direction of extension being oriented parallel to the longitudinal centre axis and the longitudinal sides of the top wall 4. The handle openings 7, 8 have rounded corners.

From the outer corners of the handle openings 7 and 8 extend fold lines 11.1, 11.2 and 12.1, 12.2 approximately diagonally to the corners of the top wall 4.

Also from the outer corners of the handle openings 7, 8 extend weakening lines 13.1, 13.2 and 14.1, 14.2 configured as perforation lines, in each case spaced apart from one another relative to the adjacent longitudinal sides of the top wall 4, said weakening lines enclosing an acute angle relative to the transverse centre axis of the top wall 4. The transverse centre axis extends perpendicular to the longitudinal sides of the top wall 4.

From the longitudinal sides of the top wall 4, the weakening lines extend in the regions 13.3, 13.4 and 14.3, 14.4, in each case in parallel into the side walls 3, 5, the adjacent weakening lines at their ends in the upper region of the lower side wall portions 3.1, 5.1 in each case being connected together by a transversely extending weakening line 13.5, 14.5.

The handle opening 7 and the weakening lines 13.1 to 13.5 as well as the handle opening 8 and the weakening lines 14.1 to 14.5 thus define in each case tear tabs 15, 16.

Bottom wall front tabs 17.1, 17.2 are articulated to the two transverse sides of the bottom wall 2. The transverse sides of the lower side wall portions 3.1, 5.1 have lower side wall front tabs 18.1, 18.2 and 19.1, 19.2 articulated thereto. Upper side wall front tabs 20.1, 20.2 and 21.1, 21.2 are articulated to the transverse sides of the upper side wall portions 3.2, 5.2.

Finally, top wall front tabs 22.1, 22.2 are articulated to the two transverse sides of the top wall 4.

The shape of the front tabs 17.1, 17.2, 18.1, 18.2, 19.1, 19.2 and 22.1, 22.2 is substantially rectangular. The front tabs 20.1, 20.2, 21.1, 21.2 have a substantially trapezoidal shape.

The blank 1 is die cut from kraftboard. Said blank has, for example, a weight of 295 g/m$^2$. Preferably, it is coated kraftboard.

Figure 2:
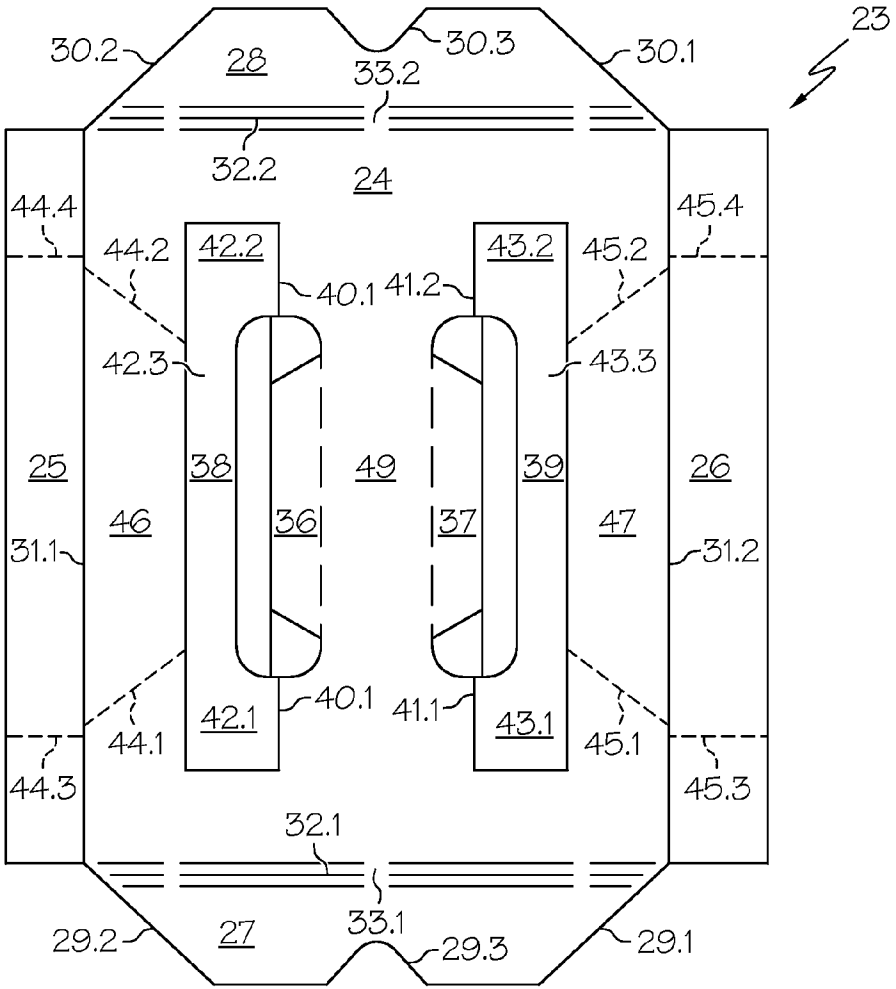
FIG. 2 shows the further blank for arranging above the group of bottles, spread out flat in plan view.

According to FIG. 1, at the top and FIG. 2, a further blank 23 has a reinforcement wall 24 which has longitudinal tabs 25, 26 articulated to the two longitudinal sides and transverse tabs 27, 28 articulated to the transverse sides.

The reinforcement wall 24 and the longitudinal tabs 25, 26 are substantially rectangular. The transverse tabs 27, 28 are substantially trapezoidal with lateral recesses formed by chamfers 29.1, 29.2 and 30.1, 30.2 on both lateral edges and central recesses formed by approximately V-shaped die cut portions 29.3, 30.3 in the two outer edges.

The longitudinal tabs are articulated to the reinforcement wall 24 via single fold lines 31.1, 31.2.

The transverse tabs are articulated via a plurality of parallel fold lines 32.1, 32.2 to the reinforcement wall 24. In the example, there are three parallel fold lines 32.1, 32.2 which in each case are interrupted in three strip-shaped regions 33.1, 33.2.

The dimensions of the reinforcement wall 24 correspond approximately to the dimensions of the top wall 4. The transverse dimensions of the longitudinal tabs 25, 26 are only approximately a quarter to half the size of the transverse dimensions of the upper side wall portions 3.2, 5.2. The dimensions of the transverse tabs 27, 28 in the longitudinal direction of the further blank 23 are approximately a quarter to a third of the dimensions of the top wall front tabs 22.1, 22.2 in the same direction.

In the reinforcement wall 24 further handle openings 34, 35 are arranged which in arrangement and size correspond to the handle openings 7, 8 of the top wall 4. The further handle openings 34, 35 also have further grip relief tabs 36, 37 articulated to their inner edges. Said grip relief tabs extend, however, in the transverse direction approximately over a third to two thirds of the transverse extent of the further handle openings. As a result, the further handle openings 34, 35 in the top wall 24 are opened from the start in an outer part.

On each of the two further handle openings 34, 35 in the reinforcement wall 24 a reinforcement tab 38, 39 is die cut. Each reinforcement tab 38, 39 is articulated to the reinforcement wall 24 via two articulation lines 40.1, 40.2, 41.1, 41.2. The articulation lines 40.1, 40.2, 41.1, 41.2 proceed from opposing sides of the further handle openings 34, 35 and extend parallel to the longitudinal sides of the top wall 4. The articulation lines 40.1, 40.2, 41.1, 41.2 proceed from the centre of the two lateral edges of the two further handle openings 34, 35.

The reinforcement tabs 38, 39 are in each case approximately rectangular, between the articulation lines 40.1, 40.2, 41.1, 41.2 of each reinforcement tab 38, 39 one half of a further adjacent handle opening 34, 35 being recessed. Thus the reinforcement tabs 38, 39 have an approximately trough-like contour in plan view.

The reinforcement tabs 38, 39 consist of two lateral strip-shaped articulation regions 42.1, 42.2, 43.1, 43.2 which are connected to the articulation lines 40.1, 40.2, 41.1, 41.2 and a strip-shaped connecting region 42.3, 43.3 bridging the articulation regions. The connecting regions 42.3, 43.3 of the two reinforcement tabs 38, 39 are arranged on sides of the further handle openings 34, 35 which are remote from one another.

The articulation lines 40.1, 40.2, 41.1, 41.2 are, in the example, formed by interrupted stamped lines. They may also be formed by score lines.

Further weakening lines 44.1, 44.2, 45.1, 45.2 extend from the outer longitudinal sides of the reinforcement tabs 38, 39 towards the longitudinal sides of the reinforcement wall 24. The further weakening lines 44.1, 44.2, 45.1, 45.2 are aligned at an acute angle to the transverse centre axis of the further blank 23. From the longitudinal sides of the reinforcement wall 24 further weakening lines 44.3, 44.4, 45.3, 45.3 extend in each case in parallel, transversely through the longitudinal tabs 25, 26.

The reinforcement tabs 38, 39 and the further weakening lines 44.1 to 44.4, 45.1 to 45.4 in each case define further tear tabs 46, 47.

The weakening lines 13.1 to 13.5, 14.1 to 14.5, 44.1 to 44.4, 45.1 to 45.4 of the blank 1 and the further blank 23 are also formed by interrupted stamped lines.

The further blank 23 is preferably formed from recycled cardboard.

Figure 3:
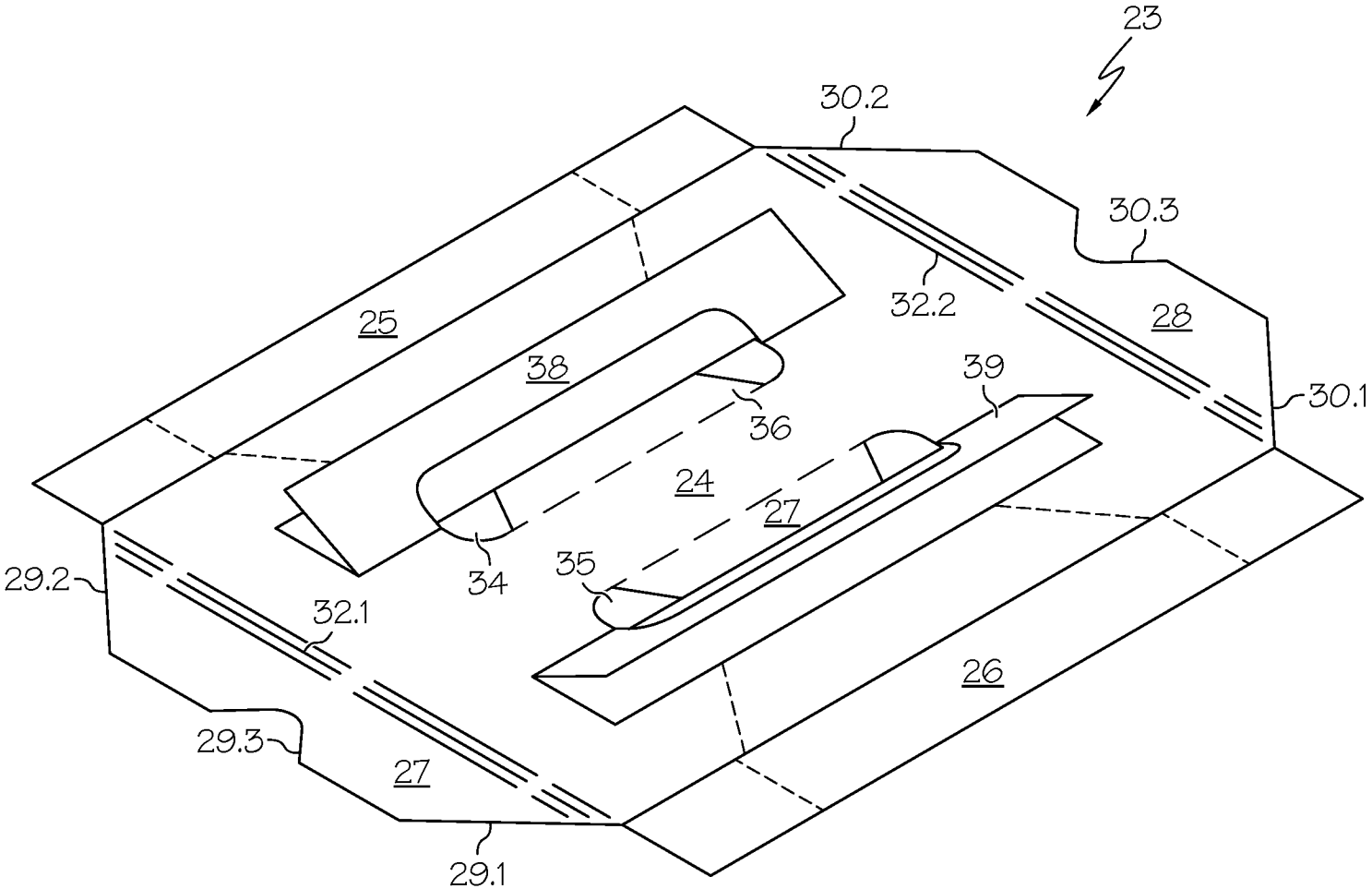
FIG. 3 shows the further blank when pivoting the reinforcement tabs, in a perspective view obliquely from above and from the side.

According to FIG. 3, the further blank 23 is prepared for connection with the blank 1, by the reinforcement tabs 38, 39 being folded towards the inner face of the reinforcement wall 24 and glued thereto.

Figure 4:
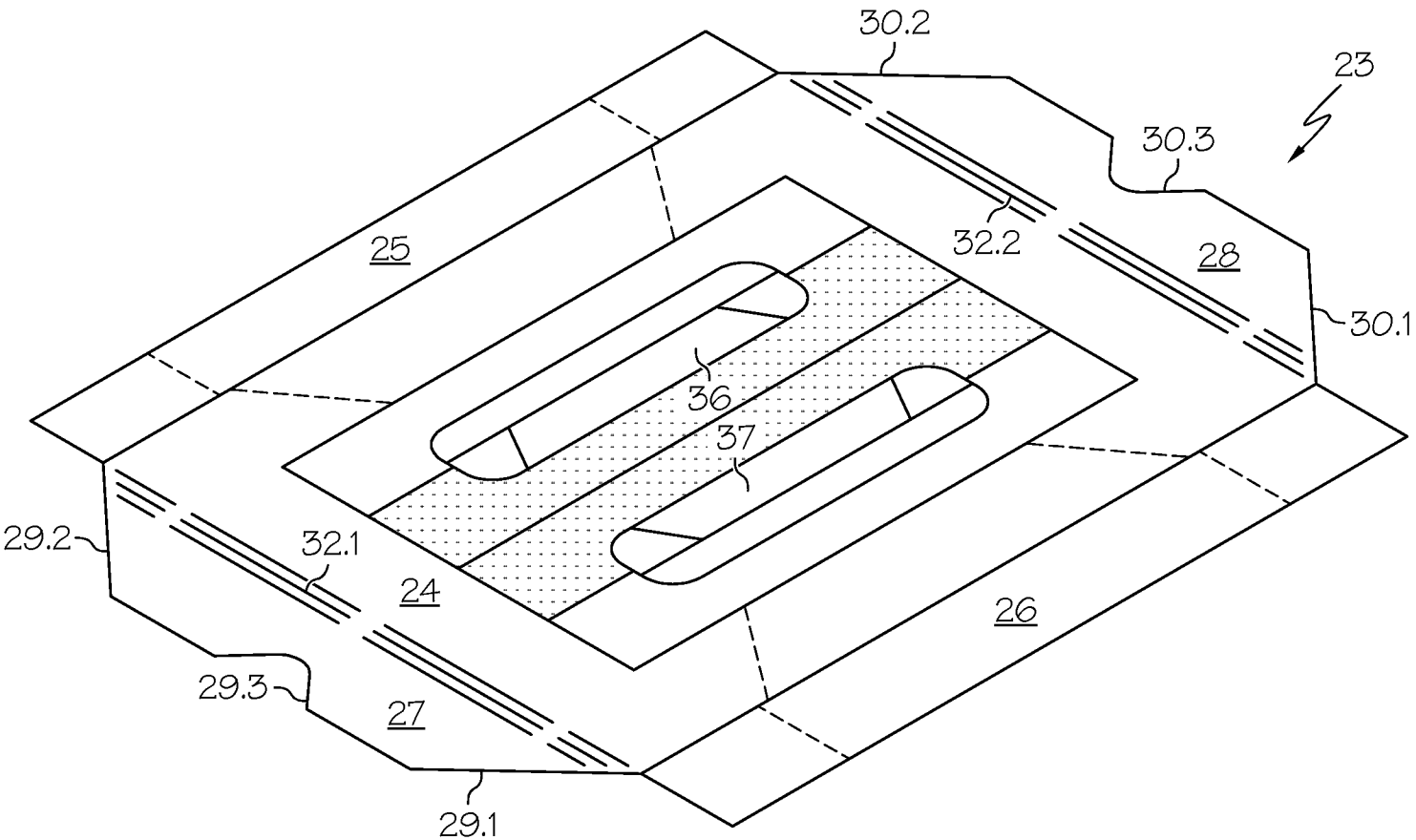
FIG. 4 shows the further blank when the reinforcement tabs have been applied and the grip relief tabs bear against the reinforcement tabs, in a perspective view obliquely from above and from the side.

In FIG. 4, the reinforcement tabs 38, 39 are shown in the glued-on state.

Figure 5:
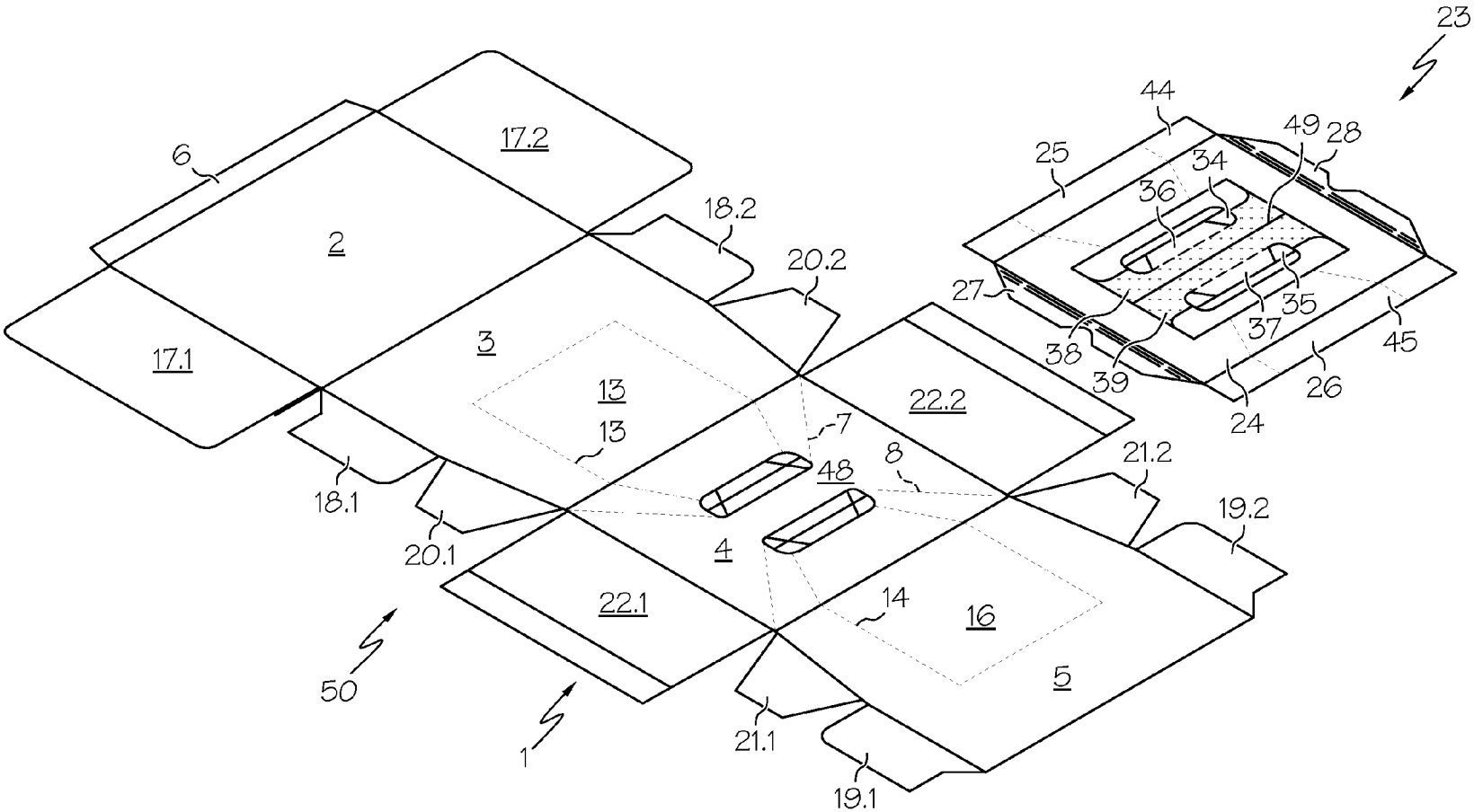
FIG. 5 shows the blank spread out flat when attaching the further blank in the state of FIG. 4, in a perspective view obliquely from above and from the side.

According to FIG. 5, the further blank 23 prepared in such a manner is attached to the inner face of the top wall 4 of the blank 1. In this case, the further handle openings 34, 35 are arranged with their edges approximately congruent above the edges of the handle openings 7, 8. Moreover, the further tear perforations 44, 45 are arranged approximately congruent above the tear perforations 13, 14 of the top wall 4 and in the adjacent regions of the side walls 3, 5.

The longitudinal tabs 25, 26 are arranged above the upper edge regions of the side walls 3, 5 and the transverse tabs 27, 28 above the upper edge regions of the top wall front tabs 22.1, 22.2. In this alignment, the further blank 23 is glued to the blank 1. Preferably, the two blanks 1, 23 are glued together in the region of the web 48 between the handle openings 7, 8 and the further web 49 between the further handle openings 34, 35. Further preferably, the tear tabs 15, 16, 46, 47 defined by the tear lines 13, 14 are glued together inside the top wall 4 and the reinforcement wall 24. Preferably the blank 1 and the further blank 23 are not glued together outside the top wall 4 and the reinforcement wall 24.

Subsequently, the adhesive tab 6 may be glued to the lower edge region of the side wall 5. To this end, the bottom wall 2 is folded in its articulation onto the side wall 3 and the side wall 5 folded around its articulation onto the top wall 4 and in the lower edge region glued to the adhesive tab 6. The container carrier 50 may be prepared to this stage at the folding carton manufacturer.

At the beverage producer, the pre-glued container carrier 50 may be erected and groups of bottles 51 inserted through the front openings between the sleeve walls 2 to 5. In this case, by means of the recess 29, 30 it is avoided that the bottles 51 remain suspended with their tops on the transverse tabs. In particular, by means of the chamfers 29.1, 29.2, 30.1, 30.2 which widen towards the outside it is achieved that the transverse tabs 27, 28 are raised when they come into contact with the bottle tops when inserting the bottles 51.

Finally, the front openings are closed, initially by the side wall front tabs 18, 19, 20, 21 being folded into the front openings, then the top wall front tabs 22 being folded towards the side wall front tabs 18, 19, 20, 21, and finally the bottom wall front tabs 17 being folded towards the top wall front tab 22 and glued thereto.

Figure 6:
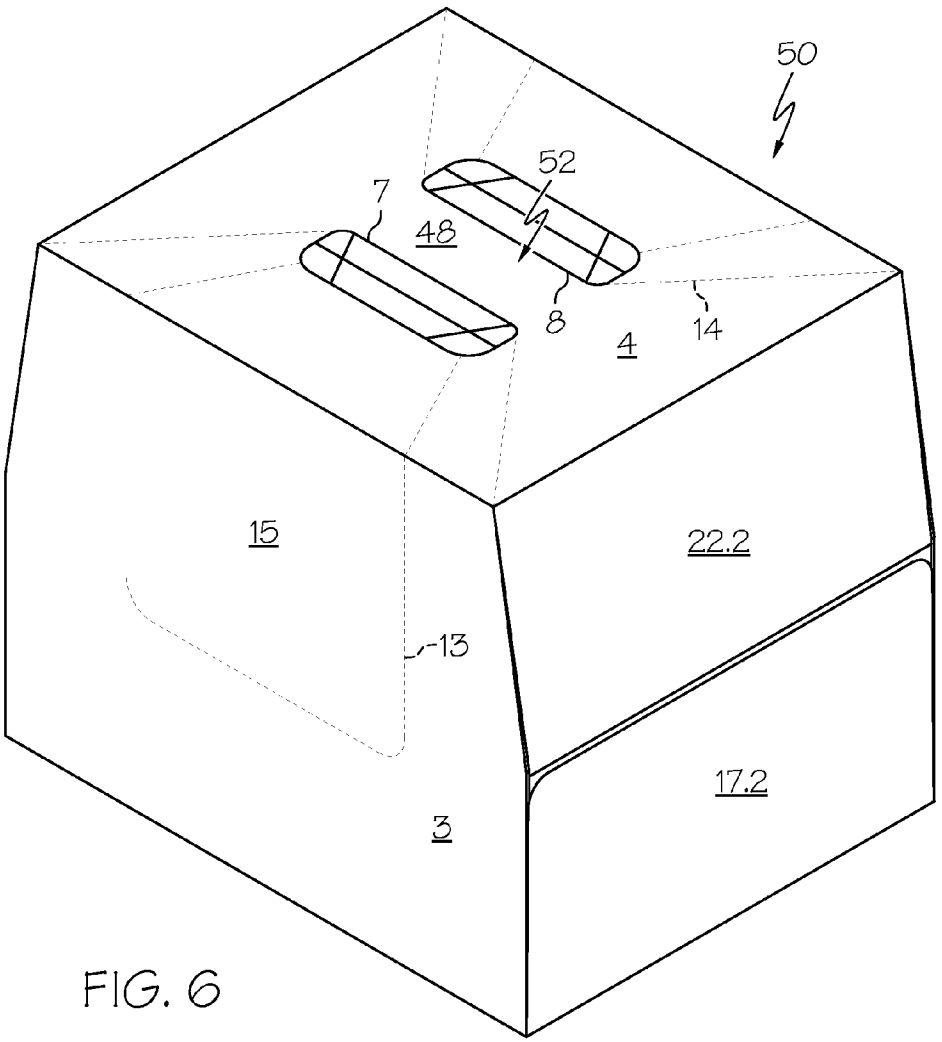
FIG. 6 shows the container carrier formed from the blank and the further blank according to FIGS. 1 to 5.
Figure 7:
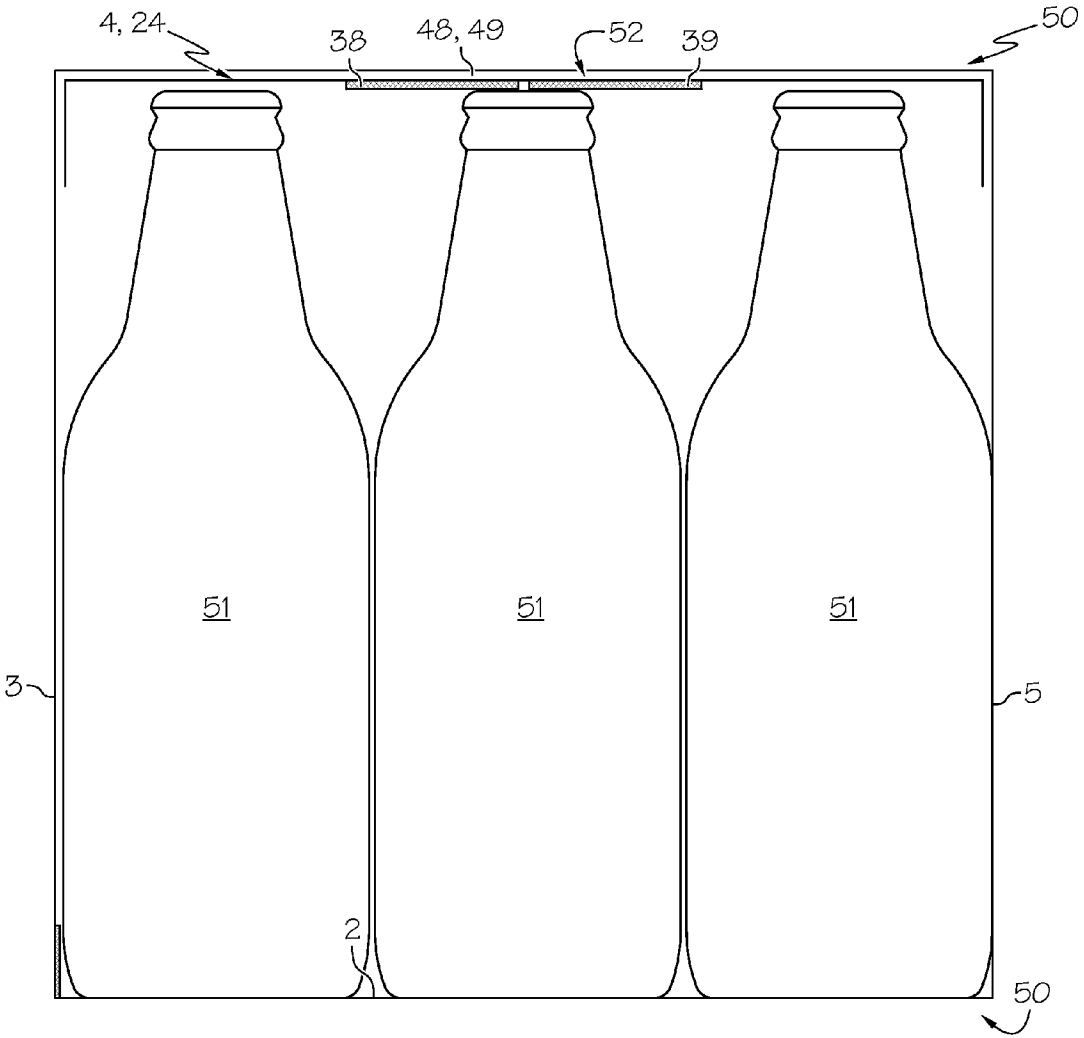
FIG. 7 shows the container carrier of FIG. 6 in a vertical section perpendicular to the longitudinal sides.

The filled container carrier 50 is shown in this state in FIG. 6. FIG. 7 shows the inserted bottles 51.

According to FIGS. 6 and 7, the webs 48, 49 form a triple-layer grip portion 52 between the handle openings 7, 8, 34, 35 and the reinforcement tabs 38, 39.

For carrying, the user presses the grip relief tabs 9, 10 into the handle openings 7, 8 and the further grip relief tabs 36, 37 downwards, so that the user is able to grip around the grip portion 52. In this case, the user encompasses a total of five layers of cardboard, which are padded on the edge by the grip relief tabs 9, 10 and the further grip relief tabs 36, 37. The container carrier is particularly comfortable to carry.

The reinforced grip portion 52 withstands large loads. The two folded-out reinforcement tabs 38, 39 weaken the reinforcement wall 24 only slightly. Due to the symmetrical arrangement of the reinforcement tabs 38, 39 in the reinforcement wall 24, the carrying forces are uniformly diverted from the grip portion 52 into the side walls 3, 5 and the corners. The fold lines 11, 12 assist the advantageous forwarding of forces into the corners. Deformations of the lateral edges and corners of the top wall 4 are avoided.

For removing bottles 51, one or more tear tabs 15, 46, 16, 47 are torn off, so that individual bottles 51 may be removed from the container carrier 50.

This completes the description of the preferred and alternate embodiments of the invention. Those skilled in the art may recognize other equivalents to the specific embodiment described herein which equivalents are intended to be encompassed by the claims attached hereto.

The invention claimed is:

1. Container carrier for bottles or other containers constructed from a blank (1) made of cardboard or a different foldable flat material for wrapping around a group of bottles or other containers (51), comprising:

a bottom wall (2), two side walls (3, 5)), and a top wall (4), the walls defining sleeve walls, each wall including longitudinal sides and front faces, adjacent sleeve walls (2 to 5) being articulated to one another on the longitudinal sides thereof, two handle openings (7, 8) in the top wall (4) spaced apart from one another and laterally defining a web (48) therebetween, an adhesive tab (6) on one longitudinal side of a sleeve wall (2) for connecting to another sleeve wall (5) or two portions of a sleeve wall separated from one another with an overlapping region for forming a sleeve wall by joining the wall portions in a congruent relationship and front walls articulated to the front faces (17 to 22) of at least one sleeve wall (2 to 5) for closing front openings formed by the sleeve walls (2 to 5) and a further blank (23) made of cardboard or a different foldable flat material to be arranged below the top wall (4) above a group of containers (51), the blank comprising:

a reinforcement wall (24) including longitudinal and transverse sides arranged below the top wall (4), two further handle openings (34, 35) in the reinforcement wall (24) arranged spaced apart from one another and arranged below the handle openings (7, 8) of the top wall (4) and longitudinal tabs (25, 26) and/or transverse tabs (27, 28) articulated to the longitudinal sides and/or to the transverse sides of the reinforcement wall (24), characterised in that adjacent each of the two further handle openings (34, 35) in the reinforcement wall (24) a reinforcement tab (38, 39) is die cut, which partially encloses the handle openings (34, 35) and is articulated to the reinforcement wall (24)

via articulation lines (40.1, 40.2, 41. 1, 41.2), which extend from opposing sides of the further handle opening (34, 35), and the reinforcement tabs (38, 39) for forming a reinforced grip portion (52) may be folded towards a further web (49) of the reinforcement wall (24) defined by the two further handle openings (34, 35).

2. Container carrier according to claim 1, in which the reinforcement tabs (38, 39) are folded towards the further web (49) of the reinforcement wall (24).

3. Container carrier according to claim 1, in which the reinforcement tabs (38, 39) in the position folded towards the reinforcement wall (24) are fixed by connecting to the reinforcement wall (24) and/or in which the reinforcement wall (24) is connected to the top wall (4).

4. Container carrier according to claim 1, in which the reinforcement tabs (38, 39) are glued to the reinforcement wall (24) and/or the reinforcement wall (24) is glued to the top wall (4).

5. Container carrier according to claim 1, in which the handle openings (7, 8) and/or the further handle openings (34, 35) are elongated and are aligned with their main directions of extension parallel to the longitudinal sides of the sleeve walls (2 to 5).

6. Container carrier according to claim 1, in which the handle openings (7, 8) and/or the further handle openings (34, 35) are substantially rectangular.

7. Container carrier according to claim 1, in which the handle openings (7, 8) and/or the further handle openings (34, 35) have inner edges and have grip relief tabs (9, 10) and/or further grip relief tabs (36, 37) articulated to their inner edges thereof.

8. Container carrier according to claim 1, in which the reinforcement tabs (38, 39) in each case with a connecting region (42.3, 43.3) connecting articulation regions (42.1, 42.2, 43.1, 43.2) together at articulation lines (40, 41) are arranged on sides remote from one another of the further handle openings (34, 35).

9. Container carrier according to claim 1, in which the reinforcement tabs (38, 39) are substantially rectangular as far as regions incorporated by the further handle openings (34, 35).

10. Container carrier according to claim 1, in which the reinforcement tabs (38, 39) cover at least 80% of the further web (49) between the two further handle openings (34, 35).

11. Container carrier according to claim 1, in which transverse tabs (27, 28) comprise recesses (29, 30), through which bottle top regions of bottles (51) may be introduced when inserted into the front openings.

12. Container carrier according to claim 11, in which the recesses (29, 30) are central recesses in the centre of the transverse tabs and/or lateral recesses on two lateral edges of the transverse tabs.

13. Container carrier according to claim 1, in which the reinforcement wall (24) is substantially congruent with the top wall (4).

14. Container carrier according to claim 1, in which proceeding from the handle openings (7, 8) in the top wall (4) and/or proceeding from die cut portions of the reinforcement tabs (38, 39) in the reinforcement wall (24) fold lines (11, 12) extend as far as adjacent corners of the top wall (4) and/or the reinforcement wall (24).

15. Container carrier according to claim 1, in which proceeding from the handle openings (7, 8) of the top wall (4) and/or from die cut portions of the reinforcement tabs (38, 39) in the reinforcement wall (24) in each case two weakening lines (13, 14, 44, 45) extend spaced apart from one another substantially in a transverse direction, as far as the longitudinal sides, and from there into the side walls (3, 5) and/or into the longitudinal tabs (25, 26), in order to form tear tabs (15, 16, 46, 47) defined by the handle openings (7, 8, 34, 35) and the weakening lines (13, 14, 44, 45).

16. Container carrier according to claim 15, in which the ends of the weakening lines (13, 14) in the side walls (3, 5) are connected together by longitudinally oriented weakening lines (13.5, 14.5).

17. Container carrier according to claim 1, in which the blank (1) is produced from kraftboard and/or recycled cardboard.

18. Container carrier according to claim 1, in which the blank (1) and/or the further blank have a weight of less than 500 g/m$^2$, preferably less than 400 g/m$^2$, in particular less than 250 g/m$^2$.

19. Container carrier according to claim 1, in which the further blank (23) is produced from recycled cardboard and/or kraftboard.

20. Container carrier according to claim 1, in which the blank (1) is produced from coated cardboard material and/or the further blank (23) is produced from uncoated cardboard material.

* * * * *